United States Patent [19]

Yahata

[11] Patent Number: 4,636,024

[45] Date of Patent: Jan. 13, 1987

[54] ELECTRICAL CONNECTOR

[75] Inventor: Katsumi Yahata, Tokyo, Japan

[73] Assignee: Hirose Electric Co., Ltd., Tokyo, Japan

[21] Appl. No.: 639,182

[22] Filed: Aug. 9, 1984

[30] Foreign Application Priority Data

Feb. 23, 1984 [JP] Japan ..... 59-24798[U]

[51] Int. Cl.[4] ..... H01R 13/58

[52] U.S. Cl. ..... 339/103 M; 339/113 R; 339/176 M

[58] Field of Search ..... 339/97 R, 97 P, 98, 339/99 R, 103 R, 103 M, 103 B, 176 R, 176 M, 113 R, 113 L, 206 R, 206 P, 103 C, 28, 148

[56] References Cited

U.S. PATENT DOCUMENTS

| | | | |
|---|---|---|---|
| 2,788,502 | 4/1957 | Schelke et al. | 339/103 R |
| 3,395,377 | 7/1968 | Straus | 339/113 L |
| 3,406,370 | 10/1968 | Gaw | 339/103 B |
| 3,510,822 | 5/1970 | Patterson | 339/113 L |
| 3,858,960 | 1/1975 | Kunkle et al. | 339/103 |
| 3,956,575 | 5/1976 | Sutherland | 339/103 R |
| 4,193,658 | 3/1980 | Dittmann et al. | 339/97 P |
| 4,211,462 | 7/1980 | Wolfthal | 339/97 R |
| 4,445,748 | 5/1984 | Evans | 339/98 |

*Primary Examiner*—Gil Weidenfeld
*Assistant Examiner*—Thomas M. Kline
*Attorney, Agent, or Firm*—Rosen, Dainow & Jacobs

[57] ABSTRACT

An electrical connector comprises a housing and an adapter. The housing is formed to include grooves which receive respective contacts for arraying the contacts at a predetermined spacing, which contacts are for connection to ends of conductors of respective covered wires in a multicore cable, bores which receive respective ones of the covered wires for arraying them at the predetermined spacing, an opening for receiving and holding the multicore cable, and a cavity formed between the opening and the plurality of grooves. The adapter, which is formed separately of the housing and received in the cavity, has a plurality of insertion holes for arraying respecting ones of the covered wires at a spacing identical with the predetermined spacing of the contacts. The insertion holes and the bores are formed so as to lie in registration with each other when the adapter is inserted into the cavity.

3 Claims, 7 Drawing Figures

ELECTRICAL CONNECTOR

BACKGROUND OF THE INVENTION

This invention relates to an electrical connector having a spacing setting adapter for bringing the covered wires of a multicore cable into registration with the contacts of a connector.

A small-size and inexpensive electrical connector referred to as a modular connector finds use in equipment such as telephones and a variety of measuring instruments.

The conventional modular connector has a modular connector plug of molded plastic and is provided at one end with a plurality of contacts having a prescribed pitch. The other end of the connector is formed to include an opening for receiving a cable comprising a plurality of covered wires. Provided within the connector forwardly of the opening are a plurality of bores for receiving the covered wires. To connect the cable to the modular connector plug, the outer covering of the cable is cut away to expose a required length of the covered wires. This end of the cable is inserted into the opening of the plug, with the covered wires being inserted into respective ones of the bores. The cable is then secured to the plug by caulking, followed by press-fitting the contacts into the plug so that the contacts bite into the conductors of the covered wires to establish an electrical and mechanical connection between the conductors and contacts.

Since the covered wires constituting the cable are long and slender and, hence, easy to bend, considerable difficulty is involved in inserting the covered wires at the exposed end of the cable into the bores through the hole at one end thereof. Though the problem will be set forth later in a more detailed description of the prior art, it should be obvious that difficulty encountered in inserting the covered wires can lead to higher assembly cost and the risk of wiring errors.

SUMMARY OF THE INVENTION

Accordingly, an object of the present invention is to provide an electrical connector free of the difficulty encountered in the prior art.

Another object of the present invention is to provide an electrical connector having an adapter for setting the spacing of covered wires constituting a multicore cable, whereby the covered wires can be connected to the connector simply, reliably and at low cost.

According to the present invention, the foregoing objects are attained by providing an electrical connector comprising a housing and an adapter. The housing has a plurality of grooves which receive respective ones of a plurality of contacts for arraying the contacts at a predetermined spacing, which contacts are for connection to ends of conductors of respective covered wires constituting a multicore cable, a plurality of bores which receive respective ones of the covered wires for arraying the covered wires at the predetermined spacing, an opening for receiving and holding the multicore cable, and a cavity formed between the opening and the plurality of grooves. The adapter, which is formed separately of the housing and received in the cavity, has a plurality of insertion holes for arraying respective ones of the plurality of covered wires at a spacing identical with the predetermined spacing of the contacts. The insertion holes and the bores are formed so as to lie in registration with each other when the adapter is inserted into the cavity.

BRIEF DESCRIPTION OF THE DRAWINGS

The drawbacks of the prior-art electrical connector mentioned briefly hereinabove and the features and advantages of an electrical connector according to the present invention will be more clearly understood from the following description taken in conjunction with the accompanying drawings in which.

DESCRIPTION OF THE PREFERRED EMBODIMENTS

Figure 1:
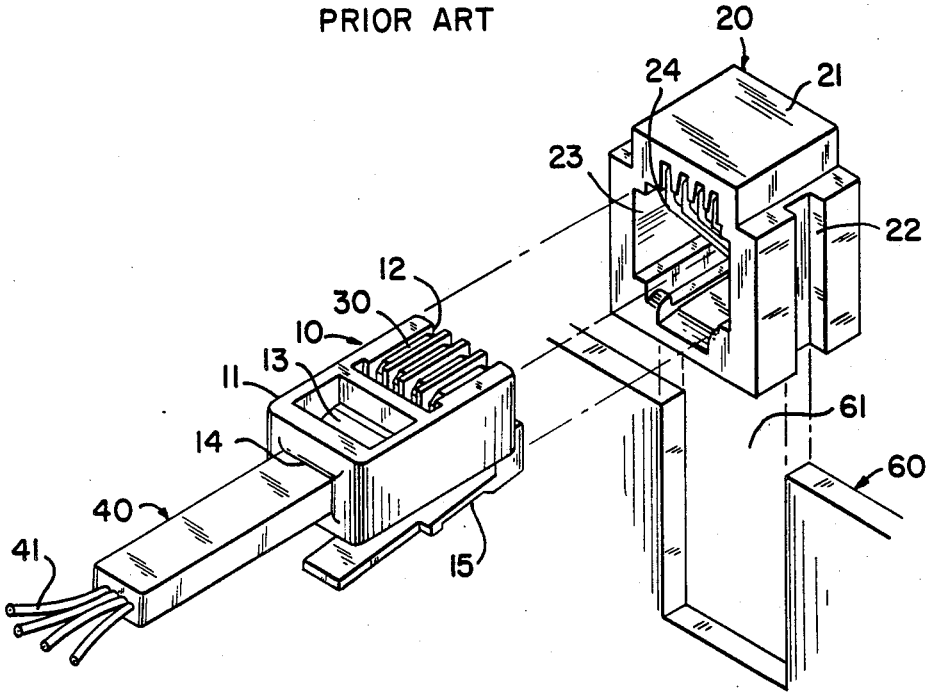
FIG. 1 PRIOR ART
FIG. 1 is perspective view illustrating a socket and plug of a modular connector according to the prior art.
Figure 2:
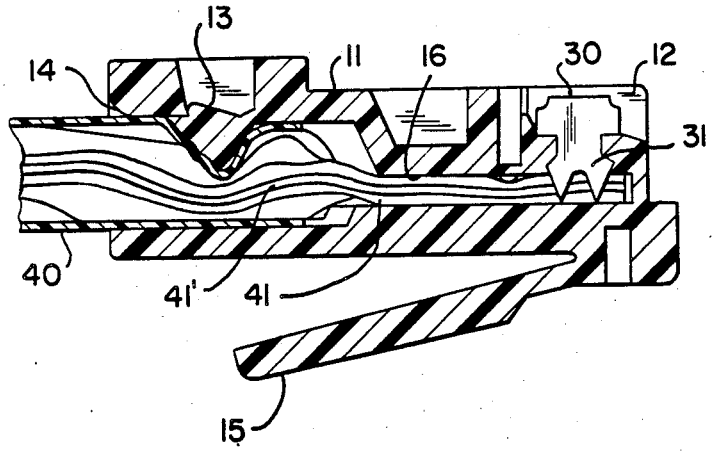
FIG. 2 PRIOR ART
FIG. 2 is a sectional view showing the plug of FIG. 1 and a cable connected thereto.

With reference to the perspective view of FIG. 1 and the sectional view of FIG. 2 in the accompanying drawings, a conventional modular connector of the above-described type comprises a modular connector plug 10 and a modular connector socket 20. In general, the modular connector plug 10 has a housing 11 molded of a plastic material. Provided on the upper side of the housing 11 at the distal end thereof are a plurality of grooves 12 for receiving respective ones of a plurality of contacts 30 at a prescribed spacing. The rear portions of the contact receiving grooves 12 have a cable fixing portion 13 for fixing a cable 40 to the housing 11 by means of stamping. The rear of the housing 11 has a end face formed to include an opening 14 for receiving the cable 40, and the lower side of the housing 11 is formed to include a locking portion 15 which is locked by being fitted into the modular connector socket 20. Provided within the housing 11 forwardly of the cable receiving opening 14 and communicating therewith are a plurality of bores 16 for receiving respective ones of a plurality of covered wires 41 constituting the cable 40. Disposed at the core of each covered wire 41 is a conductor 41', which is shown in FIG. 2.

The modular connector socket 20 has its opposing side faces formed to include a mounting channel 22 and is so adapted as to be secured to a mounting panel 60 at a mounting opening 61 thereof by engaging each channel 22, of which only one is shown, with a side edge of the opening 61. The modular connector socket 20 has a housing 21 the front side whereof includes an opening 23 for receiving the modular connector plug 10. Projecting inwardly of the opening 23 are contact pieces 24 for resiliently contacting the contacts 30 of the modular connector plug 10 when the plug is inserted into the socket 20.

In the modular connector having the foregoing construction, the cable 40 is connected to the modular connector plug 10 through the following procedure:

(1) The outer covering of the cable 40 is cut away to expose a required length of the covered wires 41. The exposed end of the cable 40 serves as the cable terminal.

(2) The terminal end of the cable 40 is inserted into the opening 14 of the housing 10, with the covered wires 41 of the cable 40 being inserted into the covered wire receiving bores 16.

(3) Next, a stamping jig, which is not shown, is lowered from above the cable fixing portion 13 of the housing 10 to press and plastically deform the fixing portion 13. This process fixes the cable 40 to the housing 10, as shown in FIG. 2.

(4) Contacts 30 are then inserted into the contact receiving grooves 12 of the housing 10, after which a jig (not shown) for press-fitting the contacts 30 is lowered from above the contacts 30 to press-fit the contacts into the grooves 12. As shown in FIG. 2, this process causes distal ends 31 of the contacts 30 to bite into the corresponding conductors 41' of the covered wires 41, whereby the conductors 41' and contacts 30 are connected both electrically and mechanically.

Figure 4:
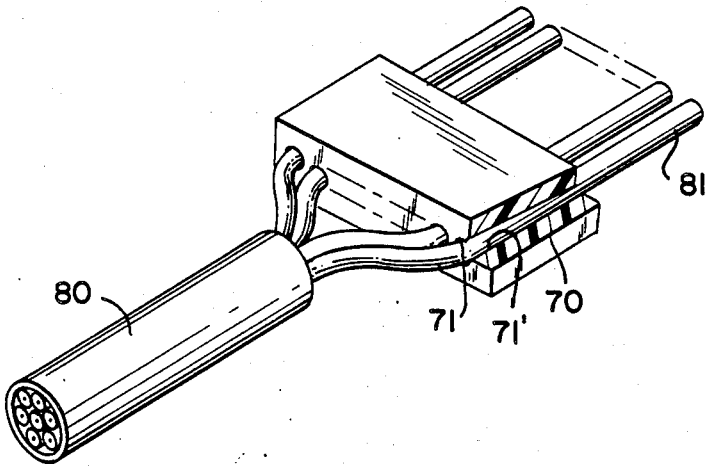
FIG. 4 is a perspective view, partially in section, showing covered wires inserted into a spacing setting adapter used in the plug of FIG. 3.

The modular connector plug 10 of the foregoing conventional construction has a number of drawbacks. Specifically, as described above, the covered wires 41 of the cable 40 at the terminal end thereof are inserted into the bores 16 through the opening 14 of the housing 10. In performing this operation, the covered wires 41 tend to bend owing to their slender shape and the considerable distance from the opening 14 to the end of the bores 16 provided inwardly of the opening 14. It is also required that each and every one of the covered wires 41 be inserted into the corresponding bores together. For these reasons, inserting the covered wires into the bores 16 involves considerable difficulty. This is particularly the case where the number of covered wires 41 is large or where the cable is of the customarily employed round type, which is shown in FIG. 4, rather than the flat cable of FIG. 1 specially designed for modular connector use. In the latter instance, since the covered wires are not arrayed in parallel in the same plane, the wires are inserted one at a time into the bores 16 inwardly of the opening 14 while they are grasped and arrayed by hand in a plane in a certain order depending upon the electrical circuitry associated therewith. Since the covered wires do not have definite spacing when spread by hand in this manner, inserting the wires is extremely difficult, thereby raising the cost of the assembly operation and inviting wiring errors.

The present invention, which contemplates to overcome the aforementioned drawbacks of the prior art, will now be described with reference to FIGS. 3 and 4.

Figure 3:
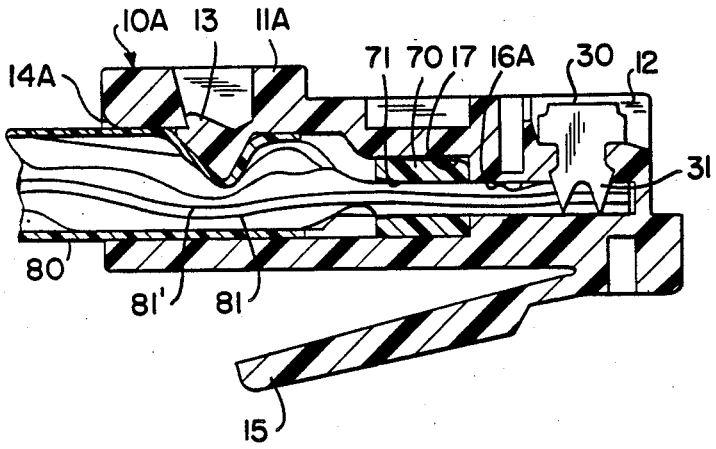
FIG. 3 is a sectional view illustrating an embodiment of an electrical connector according to the present invention, wherein a cable is connected to the connector by a plug.

FIG. 3 is a sectional view illustrating a modular connector plug 10A according to a first embodiment of the present invention. FIG. 4 is a perspective view, partially in section, showing an adapter 70 used in the connector plug 10A for setting the spacing of the covered wires 81. The covered wires 81 constitute a round cable 80 and are shown in FIG. 4 as being arrayed in parallel in the same plane. Other portions in FIGS. 3 and 4 corresponding to those of FIGS. 1 and 2 are designated by like reference characters and are not described again.

As shown in FIG. 3, the modular connector plug 10A has a housing 11A the rear side of which is provided with an opening 14A for receiving the round cable 80. Formed within the housing 11A forwardly of the cable receiving opening 14A and communicating therewith is an adapter cavity 71 for receiving the pitch correcting adapter 70. Also formed within the housing 11A forwardly of the adapter cavity 17 and communicating therewith are bores 16A for receiving the covered wires 81.

The pitch correcting adapter 70, which is to be inserted into the cavity 17, is molded of a plastic material and is best seen in FIG. 4. The adapter 70 has an external configuration and dimensions selected so that the adapter may be inserted into the cavity 17. The adapter 70 is formed to include a plurality of covered wire insertion holes 71 spaced apart to agree with the spacing of the contacts 30. Each covered wire insertion hole has a diameter large enough for the corresponding covered wire 81 to be passed therethrough with comparative ease, but not so large as to allow the wire to slip out. The entrance to each insertion hole 71 is widened or flared to facilitate the introduction of the corresponding covered wire 81.

The round cable 80 is connected to the above-described modular adapter plug 10A through the following procedure:

(1) The outer covering of the cable 80 is cut away to expose a desired length of the covered wires 81.

(2) As shown in FIG. 4, the covered wires 81, exposed by removal of the outer covering of cable 80, are inserted into the respective holes 71 of the adapter 70 in a sequence governed by the corresponding circuitry. The covered wires 81 thus inserted will have their spacing set by the adapter 70 so as to be brought into conformance with the spacing of the covered wire receiving bores 16A. The covered wires 81 protruding from the front side of the adapter 70 are cut off to a prescribed length so that the distal ends thereof lie on a substantially straight line.

(3) Next, the cable 80 attached to the adapter 70 in the above-described manner is inserted into the opening 14A of the housing 10A. Since the spacing of the covered wires 81 will agree with that of the bores 16A by virtue of the adapter 70, the covered wires penetrate the respective bores 16A smoothly.

(4) Next, a stamping jig, which is not shown, is lowered from above the cable fixing portion 13 of the housing 10A to press and plastically deform the fixing portion 13. This process fixes the cable 80 to the housing 10A.

(5) The contacts 30 are then inserted into the contact receiving grooves 12 of the housing 10A, after which a jig (not shown) for press-fitting the contacts 30 is lowered from above the contacts to press-fit them into the grooves 12. As shown in FIG. 3, this process causes distal ends 31 of the contacts 30 to bite into the corresponding conductors 81' of the covered wires 81, whereby the conductors 81' and contacts 30 are connected both electrically and mechanically. This completes the procedure for connecting the cable 80 to the modular connector plug 10A.

The modular connector plug having the foregoing construction in accordance with the present invention has the following advantages not obtainable with the prior-art arrangement:

(1) Since the covered wires 81 of the cable 80 are arranged by the adapter 70 so as to be registered with the contacts 30 of the modular connector plug 10A, even a round multicore cable which does not lend itself to easy regularization of the spacing between adjacent covered wires can be connected to the plug with its covered wires spaced apart in the proper manner. This greatly simplifies the operation for connecting the cable to the plug and lowers assembly costs.

(2) Since the covered wires 81 of the cable 80 are accommodated within the plug 10A through the adapter 70, the operations for aligning the covered wires, for inserting the covered wires into the plug 10A and for press-fitting the contacts 30 can be carried out as separate steps, thereby making it possible to perform these operations on an assembly line. This improves the assembly process, speeds up the overall operation and lowers costs.

(3) Since the operations for aligning the covered wires, for inserting the covered wires and for press-fitting the contacts can be carried out as separate steps, each step of the assembly operation is provided with flexibility so that wiring can be checked and wiring errors corrected before the press-fitting of the contacts 30. This reduces the occurrence of wiring errors.

(4) Whereas the conventional modular connector plug 10 requires exclusive use of the costly flat cable, the present invention makes it possible to employ a multicore cable having a round configuration. This reduces cost by permitting use of more inexpensive cables.

Figure 5A:
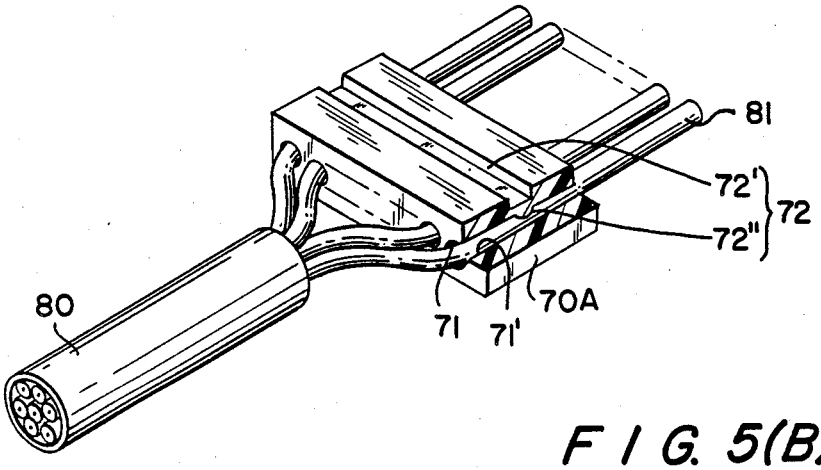
FIG. 5(A) is a perspective view, partially in section, illustrating a spacing setting adapter according to a second embodiment of the present invention.
Figure 5B:
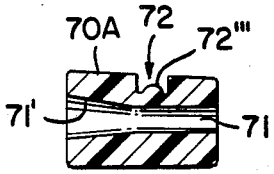
FIG. 5(B) is a sectional view of the spacing setting adapter of FIG. 5(A)

FIGS. 5(A) and 5(B) illustrate a second embodiment of the present invention using a modified form of the adapter for setting the spacing of the covered wires. As shown in FIG. 5(A), the upper side of the adapter, denoted at numeral 70A, is provided with a stamping portion 72 by forming in the upper side thereof a longitudinally extending stamping groove 72' having a projection 72'' extending into the covered wire insertion holes 71 for securing the covered wires 81. Prior to the insertion of the covered wires 81 into the holes 71, the stamping groove 72' has a projection 72''' located therein, as shown in FIG. 5(B). The covered wires 81 are passed through the insertion holes 71 and a stamping jig (not shown) is lowered from above to apply pressure to the projection 72'''. This plastically deforms the projection 72''' into the configuration shoewn in FIG. 5(A) to form the projection 72'' on the side of the insertion holes 71, thereby clamping the covered wires 81 to the adapter 70A to fix the wires securely between the projection 72'' and the inner wall of each insertion hole 71.

The covered wires 81 treated in this manner are held with their ends in perfect alignment and are fixedly secured within the adapter 70A. Therefore, when the assembly is sent directly to the next step of the production process, the covered wires 81 will not slip out of the adapter.

Figure 6:
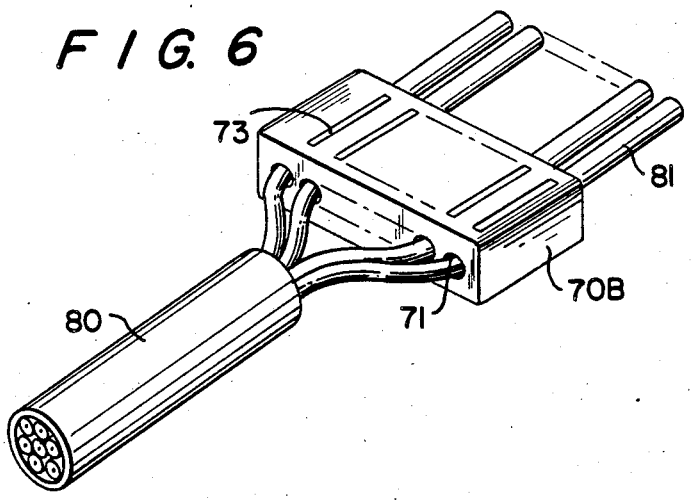
FIG. 6 is a perspective view illustrating a spacing setting adapter according to a third embodiment of the present invention.

A third embodiment of the present invention is illustrated in FIG. 6, in which the upper side of the adapter, indicated at numeral 70B, is provided with color codes 73 at positions corresponding to the covered wire insertion holes 71. Ordinarily, the covered wires 81 of the cable 80 have a colored covering so that one wire may be distinguished from another. By providing the adapter 70B with color codes matching the colors of the covered wires 81, the wires can be arrayed without the risk of wiring error.

As many apparently widely different embodiments of the present invention can be made without departing from the spirit and scope thereof, it is to be understood that the invention is not limited to the specific embodiments thereof except as defined in the appended claims.

What I claim is:

1. An electrical connector for a cable including a layer of insulation surrounding a core having a plurality of individual conductors, the ends of said conductors having said insulation layer stripped away, comprising:

a housing including a plurality of grooves for receiving respective ones of a plurality of contacts and for arraying said contacts in a predetermined pattern, said contacts being for connections respectively to said conductor ends, said housing further including a plurality of bores leading to said grooves respectively for receiving respective ones of said conductor ends for arraying said conductors in said pattern and guiding said conductors to said contacts, an inlet cavity for receiving therein and holding said cable with said insulation layer and enclosed conductors, and a central cavity formed between said inlet cavity and said plurality of bores;

an adaptor for insertion in said central cavity, said adaptor having a plurality of insertion holes passing therethrough for receiving and positioning said plurality of conductor ends in a pattern identical with said predetermined contact pattern, the contours and dimensions of said central cavity and adaptor being such that said insertion holes and said bores are in registration with each other when said adaptor is seated in said central cavity, conductor ends extending from said insertion holes of said adaptor entering said bores when said adaptor is being inserted into said central cavity, a portion of said cable including insulation being within said inlet cavity;

a stamping portion in said adaptor, said adaptor stamping portion being subject to permanent deformation by application of force thereto, said deformed adaptor stamping portion being positioned on said adaptor for pressing against conductors within said insertion holes, said adaptor deformation preventing withdrawal of said conductors from said adaptor.

2. An electrical connector as claimed in claim 1, and further comprising a stamping portion included in said housing, said housing stamping portion being subject to permanent deformation by application of force thereto, the deformed housing stamping portion being positioned on said housing for engaging and deforming the insulated portion of the cable within said inlet cavity and preventing withdrawal of said cable and conductors from said housing.

3. The electrical connector according to claim 1, wherein said adapter is provided with color codes matching colors on said conductors, said color codes being disposed at positions corresponding to positions occupied by said conductors when inserted into the insertion holes.

* * * * *